United States Patent [19]

Rubenstein

[11] 4,291,810

[45] Sep. 29, 1981

[54] PACKAGE CLIP

[76] Inventor: Irving Rubenstein, P.O. Box #4012, North Hollywood, Calif. 91607

[21] Appl. No.: 101,087

[22] Filed: Dec. 7, 1979

[51] Int. Cl.[3] ..... A47F 5/08

[52] U.S. Cl. ..... 211/89; 24/67.11; 211/71; 248/316 D

[58] Field of Search ..... 211/89, 45, 71; 24/67.3, 67.9, 67.11, 252 R, 255 R; 248/316 D, 316 B

[56] References Cited

U.S. PATENT DOCUMENTS

| | | | |
|---|---|---|---|
| 713,139 | 11/1902 | Nosker | 24/67.11 X |
| 2,400,058 | 5/1946 | Concannon | 211/89 X |
| 2,583,092 | 1/1952 | Dreyfus | 211/71 |
| 2,630,923 | 3/1953 | Makar | 211/71 |
| 2,937,758 | 5/1960 | Tabb | 211/89 X |
| 3,967,346 | 7/1976 | Young, Jr. | 248/316 D X |

FOREIGN PATENT DOCUMENTS

| | | | |
|---|---|---|---|
| 572724 | 2/1976 | Switzerland | 211/89 |

*Primary Examiner*—Roy D. Frazier
*Assistant Examiner*—Robert W. Gibson, Jr.
*Attorney, Agent, or Firm*—Richard H. Zaitlen

[57] ABSTRACT

A retaining assembly for food packages or the like including a hollow support member having a front opening and a mounting bracket near the opening. A generally V-shaped clip has a curved resilient back leg which passes through the opening and is compressed against the back wall of the support member. The clip includes a front leg which is pivotally mounted to the mounting bracket. The front leg includes an outwardly extending portion located beyond the pivot point, which is clamped against the front of the support member by the action of the back leg.

6 Claims, 3 Drawing Figures

PACKAGE CLIP

BACKGROUND OF THE INVENTION

1. Field of the Invention

This invention relates to clip devices, and more particularly, to the design and construction of clips for holding articles in racks for sale or display.

2. Prior Art

A number of clips have been disclosed in the prior art, including some for arranging clips in racks and for displaying or selling packaged food articles. Clips for displaying or selling packaged food articles should be durable, retain their shape and position, be easy to use by consumers and retailers, and be economical to manufacture. Although various prior art devices meet some of these requirements, no prior design fully meets all of them.

U.S. Pat. No. 3,967,346 to Young, Jr., shows an S-shaped steel clip which fits into a hollow support tube. The major disadvantage of this device is that it is designed to be made from steel. This results in a spring that will fatigue, bend, and ultimately break, such problems also being caused by the stresses of a tight S-shape. It is also more expensive than a plastic clip. This design is not readily adaptable for construction with plastic materials. A further structural disadvantage of the Young clip is that it can slip out of the support tube laterally when forces are applied in the wrong directions.

U.S. Pat. No. 2,532,021 to Gunderson shows a prior art spring clip which solves, to a certain extent, the tendency of clips to fall out of or turn in the support stand. However, the design of this clip is such that it is subject to fatigue, bending, and breaking about its center section.

U.S. Pat. No. 3,309,052 to Borisof shows several designs for plastic clips. One design has a "push button" release action. However, the point of rotation of the clip, when opened, is fixed with respect to the base. This results in a high tendency to fatigue and break at the point of rotation.

Thus, each of the prior art devices have some or all of the following disadvantages: they are more expensive to make, of such a design that they are subject to fatiguing, bending, breaking, or coming loose, lack a "push button" release, or lack a means of securely holding an article in place beyond the use of spring tension.

SUMMARY OF THE INVENTION

It is a primary object of this invention to provide a clip device which can be manufactured out of inexpensive materials and is not subject to fatigue, bending, or breaking.

It is another object of this invention to provide a clip device which is easy to operate.

It is yet another object of this invention to provide a clip device which may be disposed in a rack with a plurality of similar clip devices which can then be used to hold packages for display or sale.

The present invention comprises a V-shaped spring clip, having a curved first leg section which passes through an opening in the front of a hollow support member and resiliently presses against the far inside wall of the support member. The second leg of the V-shaped clip lies outside the support member, is indented near its middle point and is pivotally attached to the support member on either side of the leg at the point of indentation. The second leg has a tooth on its distal end which selectively engages a groove in the front of the support member. When the junction of the two legs of the V-shaped clip is pushed toward the support member, the first leg flexes against the inside wall of the support member and the second leg pivots, pulling the tooth away from the groove in the support and allowing articles to be inserted or removed. When the pushing force is released, the resilient curved interior spring leg causes the outside leg to pivot back towards the support member front surface, thereby clamping any inserted articles between the tooth of the pivoting front leg and the groove in the support member.

The novel features which are believed to be characteristic of the invention, both as to its organization and method of operation, together with further objectives and advantages thereof, will be better understood from the following description considered in connection with the accompanying drawings in which a presently preferred embodiment of the invention is illustrated by way of example. It is to be expressly understood, however, that the drawings are for the purpose of illustration and description only, and are not intended as a definition of the limits of the invention.

DETAILED DESCRIPTION OF THE INVENTION

Figure 1:
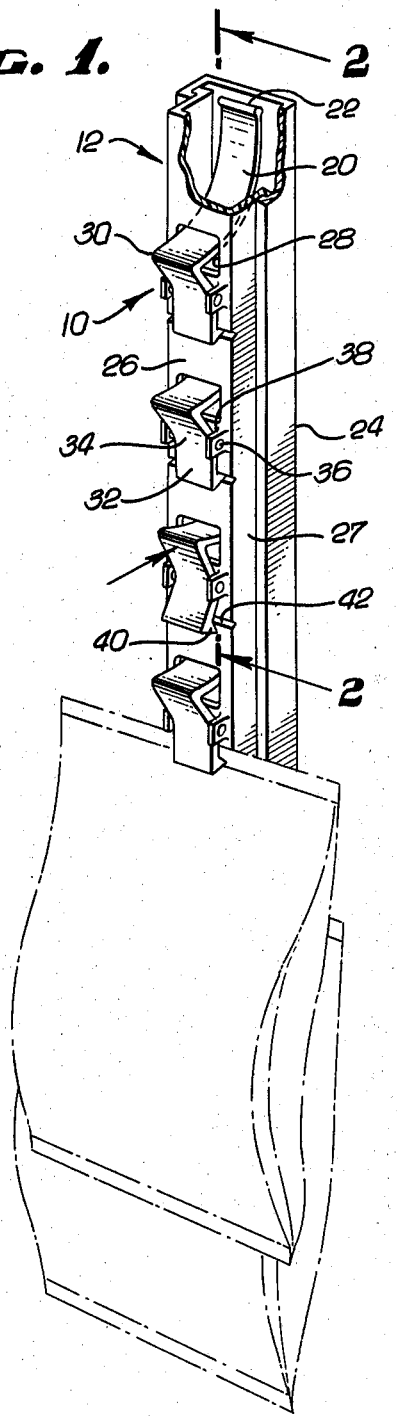
FIG. 1 is a perspective view, partially cut-away of four clip devices of the present invention secured to a support member.
Figure 2:
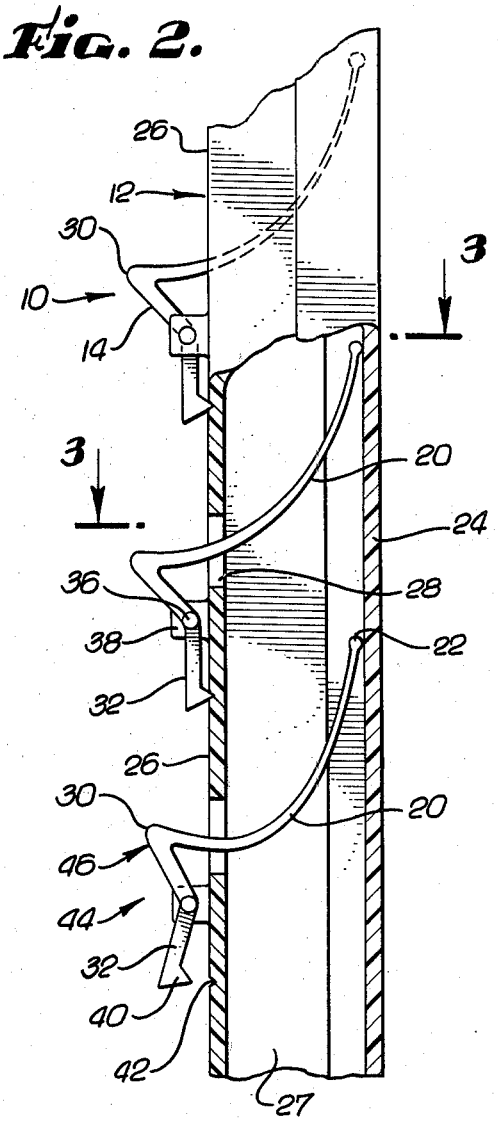
FIG. 2 is a cross-sectional view taken along lines 2—2 of FIG. 1 showing the internal aspects of the clip of the present invention when disposed in a support member.

Referring first to FIGS. 1 and 2, the package clip device 10 of the present invention is shown. The clip 10 comprises a molded generally V-shaped member 14 which includes a curved back leg 20 and a front leg 32, along with a means for pivoting the front leg 32. In the preferred embodiment, the clip device 10 is disposed on a support member 12 for supporting a plurality of clips 10 in position for holding a number of packages in a display.

The curved leg 20 and front leg 32 are connected at an elbow 30 such that the angle formed by the two legs is approximately 55 degrees (this angle is not critical). The leg 20 curves away from the front leg 32. At the distal end of the curved leg 20 is disposed a rounded head 22.

At a line 34 near the center of the front leg 32 the front leg 32 is bent at approximately a 45 degree angle away from the curved leg 20. A triangular tooth 40 extends from the end of the front leg 32 perpendicular to the front leg 32 and toward the support member 12.

The support member 12 may comprise one hollow tube, or as illustrated, a rear support member 24 having an inwardly flanged U-shaped cross-section and a smaller front support member 26 having an outwardly flanged U-shaped cross-section, thus allowing the front support member 26 to fit inside the rear support member 24 with the flanges of the respective members selectively engaging each other.

Figure 3:
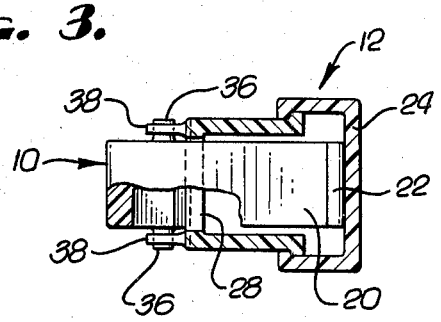
FIG. 3 is cross-sectional view taken along lines 3—3 of FIG. 2 showing the internal aspects of the clip of the present invention when disposed in a support member as viewed from above.

Disposed in the front surface of the front support member 26 is a hole 28 through which the leg 20 passes. Directly beneath hole 28 and extending outwardly from the front support member 26 are two brackets 38, one located at each edge of the front support member 26. Extending outwardly from and perpendicular to the edge of the front leg 32 at the center line 34 are two pins 36, one on each side of the front leg 32. Each pin 36 engages a hole in a bracket 38 as seen in FIG. 3. The clip 10 is thereby held between the brackets 38 in such a position that the elbow 30 is positioned directly in front of hole 28. Curved leg 20 extends backward from the elbow 30 through the hole 28 and into a hollow channel 27 between front support member 26 and rear support member 24. Front leg 32 extends downwardly from the brackets 38, generally parallel to the front face of the front support member 26, with the tooth 40 extending inwardly towards front support member 26 and selectively engaging a groove 42 in the face thereof. The rounded head 22 of the curved leg 20 engages the back wall of the rear support member 24, thus flexing the curved leg 20 to cause an outward force to be exerted on the elbow 30. This exerts a rotational force about the axis formed by pins 36 in the front leg 32 and thus holds the distal end of the front leg 32 with the tooth 40 tightly against the groove 42.

Referring again to FIG. 2, one can see the operation of the package clip device 10 of the present invention.. When a force in a direction indicated by arrow 46 is exerted on the elbow 30, the front leg 32 is pivoted about pins 36. This disengages the tooth 40 from groove 42, leaving an open space between the tooth 40 and the face of the front support member 26. The bottommost clip in FIG. 2 is shown in an opened position. The force 46 exerted on the elbow 30 also causes the curved leg 20 to be bent further, thus creating more tension in the leg 20. When the force 46 is released, this tension causes a force to be exerted in the opposite direction to that of the original force 46, thus causing the front leg 32 to pivot about pins 36 so that the tooth 40 is again forced to engage groove 42, thereby securing any object which had been placed between said tooth 40 and groove 42 while the clip 10 was in the open position.

Normally, the support means 12 will comprise an elongated front support member 26 with a plurality of holes 28 and brackets 38 disposed at intervals along its length. This allows several clips 10 to be disposed on a single support member 12. In the preferred embodiment, the front support member 26 which holds a plurality of clip devices 10 can be disengaged from the rear support member 24 by sliding it along its length, thus allowing the use of various different support members. This configuration allows the simple changing of (a) clip strength, (b) spacing of clips, and (c) depth of hollow chambers 27. The changing of the depth of the hollow chamber 27 will allow adjustment of the tension exerted by the bending of the curved leg 20 as it presses against the rear wall of the rear support member 24. The strength of the clip devices 10 may be changed by altering the flexibility of the material used or by making the legs themselves thicker.

While a wide variety of materials, shapes and other configurations can be used in this invention, it should be understood that changes can be made without departing from the spirit or scope thereof. For example, in the preferred embodiment, all assemblies are composed of molded plastic. Of course, other materials such as metal are within the scope of the present invention. This invention, therefore, is not to be limited to the specific embodiments discussed and illustrated herein, but rather by the appended claims.

What is claimed is:

1. An article retaining assembly comprising:

a hollow support member having a front opening and a mounting bracket located adjacent the front opening; and a generally V-shaped clip having a front leg pivotally secured to the mounting bracket and a resilient back leg curved away from said front leg and passing through the opening, said back leg compressed against a surface at the rear of the support member, whereby the compressed back leg will cause the front leg to pivot and force the free end of the front leg against the front of the support member.

2. The assembly of claim 1 wherein:

the free end of the front leg has a tooth extending toward the support member; and the front of the support member includes a groove which receives the tooth.

3. An article retaining assembly comprising:

a hollow support member having a front opening and a mounting bracket located adjacent the front opening; and a generally V-shaped clip having a front leg having an outwardly bent portion at a free end and pivotally secured to the mounting bracket near the location of the bend, and a resilient back leg which passes through the opening and is compressed against a surface at the rear of the support member, whereby the compressed back leg will cause the front leg to pivot and force the free end of the front leg against the front of the support member.

4. An article retaining assembly comprising:

a hollow support member having a front opening and a mounting bracket located adjacent the front opening, said mounting bracket comprising a pair of spaced arms extending outwardly from the front of the support member, each of the arms including an inwardly facing opening; and a generally V-shaped clip having a front leg pivotally secured to the mounting bracket, said front leg including a pair of opposed pegs, one each extending outwardly from the sides of the front leg, said pegs pivotally engaging the holes in the arms, and a resilient back leg which passes through the opening and is compressed against a surface at the rear of the support member, whereby the compressed back leg will cause the front leg to pivot and force the free end of the front leg against the front of the support member.

5. An article retaining assembly comprising:

a front support member having an outwardly flanged U-shaped cross-section, a front opening and a mounting bracket disposed on said front support member adjacent the front opening and a rear support member having an inwardly flanged U-shaped cross-section, said front and rear support members joined together in sliding engagement; and a generally V-shaped clip having a front leg pivotally secured to the mounting bracket and a resilient back leg which passes through the opening and is compressed against a surface at the rear of the support member, whereby the compressed back leg will cause the front leg to pivot and force the free end of the front leg against the front of the support member.

6. An article retaining assembly comprising:

a hollow support member having a plurality of front openings and a plurality of mounting brackets located adjacent associated front openings; and a plurality of generally V-shaped clips, each clip having a front leg pivotally secured to an associated mounting bracket and a resilient back leg which passes through an associated opening and is compressed against a surface at the rear of the support member, whereby the compressed back leg will cause the front leg to pivot and force the free end of the front leg against the front of the support member.

* * * * *